US009605675B2

(12) United States Patent
Park et al.

(10) Patent No.: US 9,605,675 B2
(45) Date of Patent: Mar. 28, 2017

(54) SCROLL COMPRESSOR WITH AN ARCUATE AND A LOGARITHMIC SPIRAL SECTIONS

(71) Applicant: LG ELECTRONICS INC., Seoul (KR)

(72) Inventors: Inwon Park, Seoul (KR); Seheon Choi, Seoul (KR); Byeongchul Lee, Seoul (KR); Byungkil Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 341 days.

(21) Appl. No.: 14/299,077

(22) Filed: Jun. 9, 2014

(65) Prior Publication Data

US 2014/0363325 A1 Dec. 11, 2014

(30) Foreign Application Priority Data

Jun. 10, 2013 (KR) ..... 10-2013-0065954

(51) Int. Cl.
*F04C 18/04* (2006.01)
*F04C 18/02* (2006.01)
*F01C 1/02* (2006.01)

(52) U.S. Cl.
CPC ..... *F04C 18/04* (2013.01); *F01C 1/0246* (2013.01); *F04C 18/0215* (2013.01); *F04C 18/0269* (2013.01); *F04C 18/0284* (2013.01); *F04C 2250/20* (2013.01); *F04C 2250/301* (2013.01)

(58) Field of Classification Search
CPC ..... F01C 1/0246; F04C 18/0269; F04C 2250/301; F04C 18/0215; F04C 18/0284
See application file for complete search history.

(56) References Cited

U.S. PATENT DOCUMENTS 5,425,626 A 6/1995 Tojo et al. ..... 418/55.2
5,427,512 A * 6/1995 Kohsokabe ..... F01C 1/0246 418/55.2
6,149,411 A * 11/2000 Bush ..... F04C 18/0269 418/55.2
6,174,150 B1 * 1/2001 Tsubono ..... F04C 18/0269 418/55.5
6,273,691 B1 * 8/2001 Morimoto ..... F04C 28/26 418/55.1
6,345,967 B1 * 2/2002 Mukai ..... F04C 18/0269 418/55.2

(Continued)

FOREIGN PATENT DOCUMENTS

EP 1 024 288 A1 8/2000

OTHER PUBLICATIONS

European Search Report dated Aug. 26, 2014, issued in Application No. 14171439.4.

*Primary Examiner* — Mary A Davis
(74) *Attorney, Agent, or Firm* — Ked & Associates LLP

(57) ABSTRACT

A scroll compressor is provided which is configured such that an arcuate section may be formed from a suction end of a wrap to a first point to increase a suction volume, and a logarithmic spiral section in which a wrap thickness increases may be formed from a second point to a discharge end of the wrap. This may increase a volume ratio of the compressor so as to increase a capacity of the compressor and prevent damage to the wrap due to a high compression ratio operation, thereby enhancing reliability of the compressor.

11 Claims, 7 Drawing Sheets

(56) References Cited

U.S. PATENT DOCUMENTS

| | | | | |
|---|---|---|---|---|
| 2012/0045357 | A1 | 2/2012 | Huang | 418/55.2 |
| 2013/0004354 | A1 | 1/2013 | Kiem et al. | 418/55.2 |
| 2016/0146206 | A1* | 5/2016 | Choi | F04C 18/0223 418/55.1 |

* cited by examiner

*FIG. 7*

| | A path | B path | | A path | B path | |
|---|---|---|---|---|---|---|
| | SUCTION AREA($mm^2$) | DISCHARGE AREA($mm^2$) | VR | SUCTION AREA($mm^2$) | DISCHARGE AREA($mm^2$) | VR |
| THE PRESENT DISCLOSURE (ARCUATE+ LOGARITHMIC SPIRAL) | 1092.3 | 361.3 | 3.02 | 975.6 | 361.3 | 3.11 |
| THE RELATED ART (LOGARITHMIC SPIRAL+ LOGARITHMIC SPIRAL) | 907.5 | 291.7 | 2.7 | 784.7 | 291.7 | 2.69 |

SCROLL COMPRESSOR WITH AN ARCUATE AND A LOGARITHMIC SPIRAL SECTIONS

CROSS-REFERENCE TO RELATED APPLICATION(S)

Pursuant to 35 U.S.C. §119(a), this application claims priority to Korean Application No. 10-2013-0065954, filed in Korea on Jun. 10, 2013, the contents of which is incorporated by reference herein in its entirety.

BACKGROUND

1. Field

A scroll compressor is disclosed herein.

2. Background

In general, a refrigerant compressor may be applied to a vapor compression type refrigerating cycle (hereinafter, referred to as a "refrigerating cycle"), such as a refrigerator or an air conditioner. Refrigerant compressors may include a uniform speed type compressor, which operates at a uniform speed, and an inverter type compressor, whose rotational speed is controlled.

A refrigerant compressor, in which a drive motor, which is generally an electric motor, and a compression device driven by the drive motor are all installed within an inner space of a hermetic casing, may be a hermetic compressor. A refrigerant compressor, in which a drive motor is separately installed outside of a casing, may be an open type compressor. Most household or commercial refrigerating apparatuses employ the hermetic compressor.

The refrigerant compressors may be classified into a reciprocating type, a scroll type, and a rotary type according to a method of compressing a refrigerant. The scroll compressor is a compressor in which a fixed scroll is fixed in an inner space of a hermetic container, and an orbiting scroll orbits while being engaged with the fixed scroll such that a pair of compression chambers, which continuously move between a fixed wrap of the fixed scroll and an orbiting wrap of the orbiting scroll, are formed.

The scroll type compressor is widely used to compress a refrigerant in an air-conditioning apparatus, by virtue of advantages of obtaining a relatively higher compression ratio than other types of compressors and obtaining a stable torque resulting from a smooth connection of suction, compression, and discharge strokes of a refrigerant.

However, as the related art scroll compressor, as illustrated in FIG. 1, has a fixed wrap (a shape of this wrap is the same as that of the orbiting wrap, and thus, the orbiting wrap will be representatively described) of the fixed scroll, and an orbiting wrap 1*a* of an orbiting scroll formed in an involute shape, the wraps are eccentrically formed. Accordingly, an area (A) which cannot be used as a compression chamber is formed at an outer portion of each scroll 1 (fixed scroll not illustrated). As a result, a compression capacity is lowered for a same diameter, or an outer diameter of the compressor is increased for the same capacity.

Also, when the fixed wrap and the orbiting wrap 1*a* of the related art are formed in the shape of the involute curve, a thickness (t) of each wrap is typically uniform and a capacity variation ratio constant. Therefore, in order to obtain a high volume ratio (namely, a high compression ratio) in the scroll compressor, a number of turns of the wrap or a height of the wrap has to be increased. However, if the number of turns of the wrap is increased, the compressor is increased in size, and if the height of the wrap is increased, intensity of the wrap is lowered. This results in lower reliability of the compressor.

BRIEF DESCRIPTION OF THE DRAWINGS

Embodiments will be described in detail with reference to the following drawings in which like reference numerals refer to like elements, and wherein:

FIG. 7 is a graph illustrating changes in a volume ratio in a case of applying the related art wrap formed in a shape of an involute curve and in a case of applying a wrap formed in a shape of an arcuate curve according to embodiments disclosed herein.

DETAILED DESCRIPTION

Figure 1:
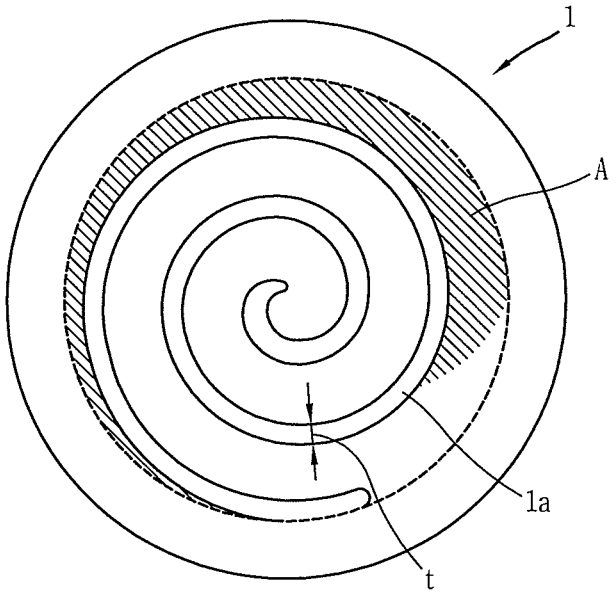
FIG. 1 RELATED ART
FIG. 1 is a planar view illustrating a wrap shape of an orbiting wrap of a scroll compressor according to the related art.

Description will now be given in detail of embodiments, with reference to the accompanying drawings. Where possible, like reference numerals have been used to indicate like elements, and repetitive disclosure has been omitted.

Figure 2:
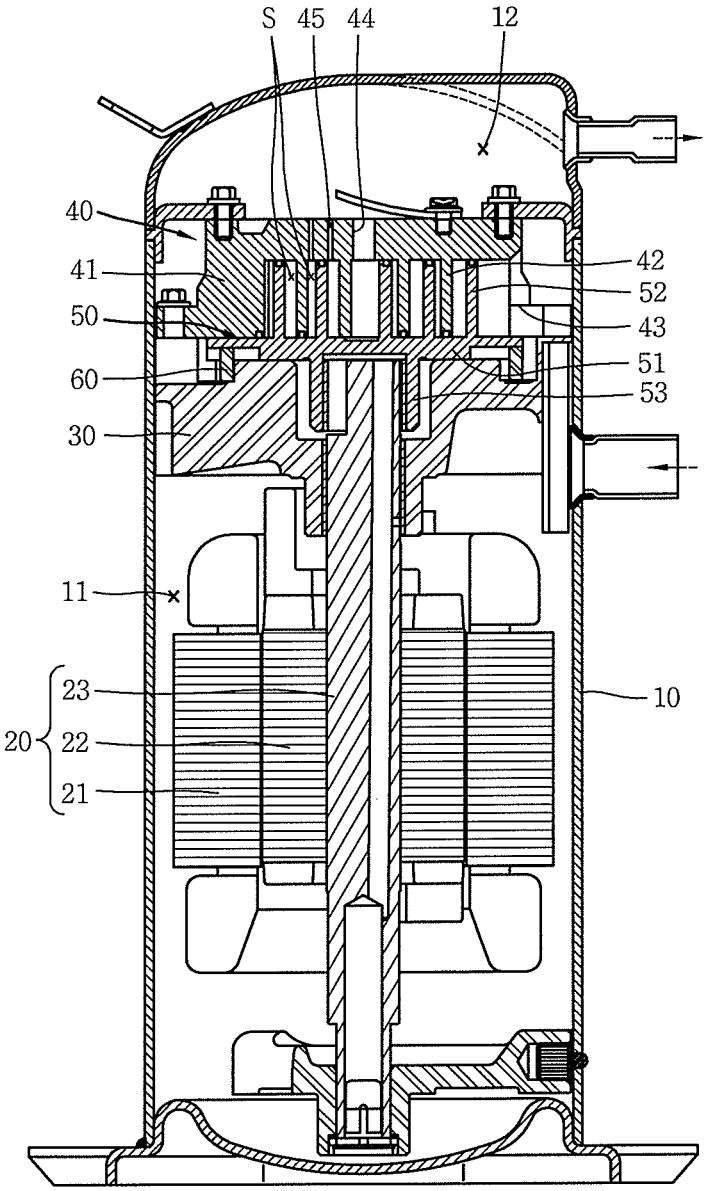
FIG. 2 is a longitudinal, cross-sectional view of a scroll compressor in accordance with an embodiment.
Figure 3:
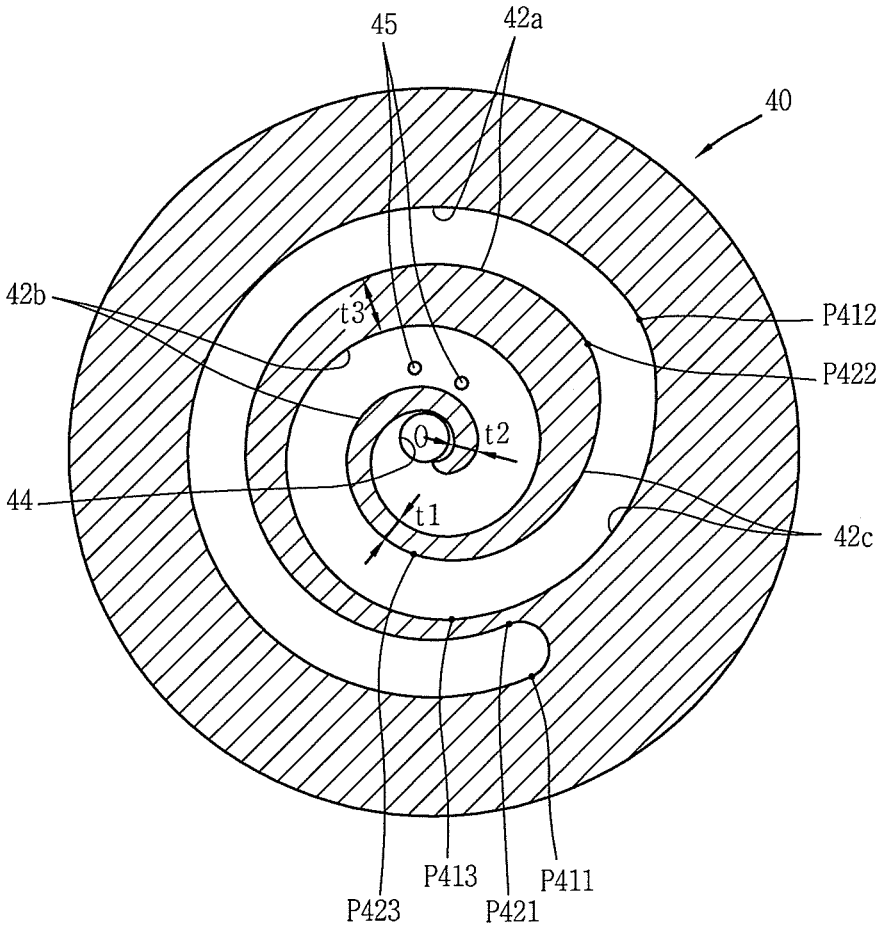
FIGS. 3 and 4 are planar views, respectively, illustrating wrap shapes of a fixed wrap and an orbiting wrap of the scroll compressor of FIG. 2.
Figure 4:
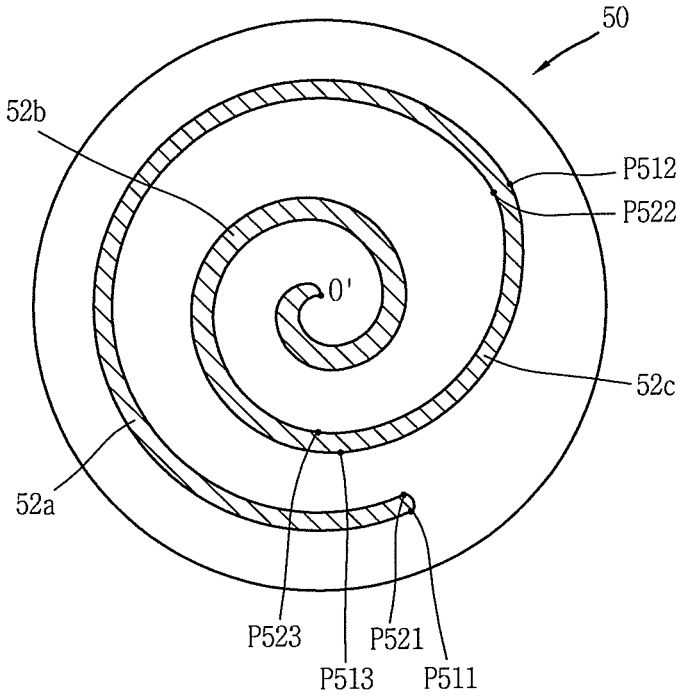
Figure 5:
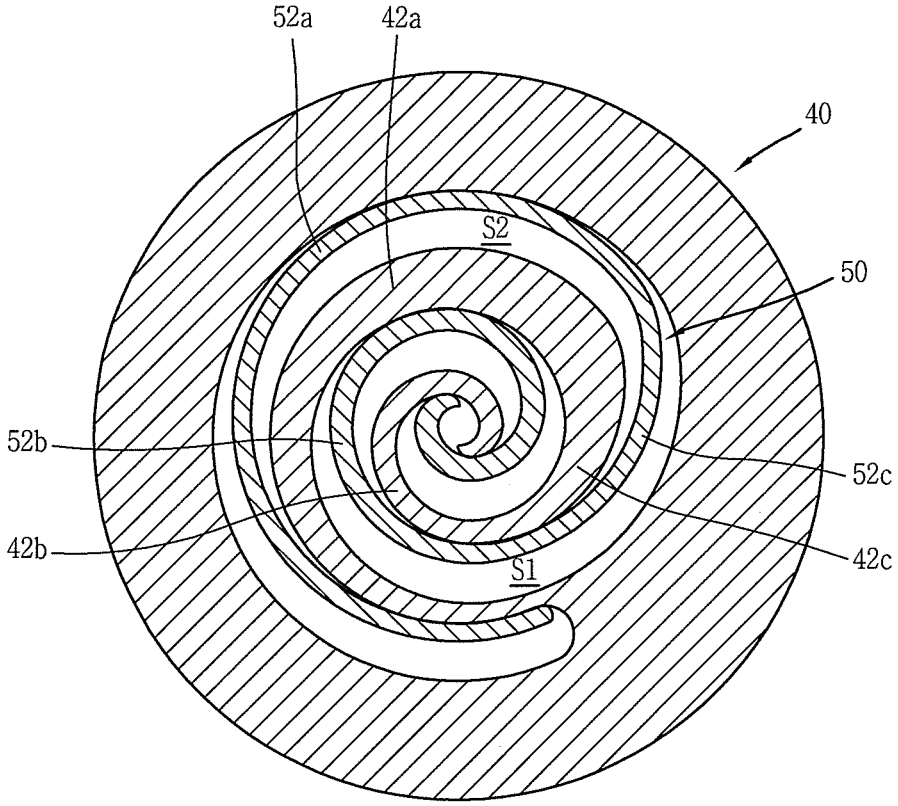
FIG. 5 is a planar view illustrating a coupled state of the fixed wrap and the orbiting wrap illustrated in FIGS. 3 and 4.

FIG. 2 is a longitudinal, cross-sectional view of a scroll compressor in accordance with an embodiment, FIGS. 3 and 4 are planar views, respectively, illustrating wraps shapes of a fixed wrap and an orbiting wrap of the scroll compressor of FIG. 2. FIG. 5 is a planar view illustrating a coupled state of the fixed wrap and the orbiting wrap illustrated in FIGS. 3 and 4.

As illustrated in the drawings, a scroll compressor having a wrap shape according to embodiments disclosed herein may include a drive motor 20, which may be installed in an inner space of a hermetic casing 10 to generate a rotational force, and a main frame 30, which may be fixedly installed above the drive motor 20.

A fixed scroll 40 may be fixedly installed on an upper surface of the main frame 30. An orbiting scroll 50 may be orbitably installed between the main frame 30 and the fixed scroll 40. The orbiting scroll 50 may be eccentrically coupled to a crankshaft 23 so as to form a pair of compression chambers S, which continuously move, together with the fixed scroll 40. An Oldham ring 60, which prevents rotation of the orbiting scroll 50, may be installed between the fixed scroll 40 and the orbiting scroll 50.

The fixed scroll 40 may include a fixed wrap 42, which may protrude from a lower surface of a disk 41 so as to form scroll-side compression chambers S together with an orbiting wrap 52 of the orbiting scroll 50, which will be discussed hereinbelow. A suction groove 43 may be formed on an outer end portion of the fixed wrap 42, namely, at an end side of the fixed wrap 42. A discharge opening 44 may be formed at an inner end portion of the fixed wrap 42, namely, at a start end of the fixed wrap 42.

The fixed wrap 42 may be formed by a plurality of curves. That is, as illustrated in FIG. 3, the fixed wrap 42 may include an arcuate section 42*a* formed at an outer portion of the fixed wrap 42, a logarithmic spiral section 42*b* formed at an inner portion of the fixed wrap 42, and a multi-curve section 42*c* that connects the arcuate section 42*a* and the logarithmic spiral section 42*b*.

For example, the arcuate section 42*a* of the fixed wrap 42 may be formed in a shape of an arcuate curve with a same radius, with respect to a discharge end 0 of the fixed wrap 42, from a suction end P411 of an outer surface of the wrap to a first point P412 of or along the outer surface. The logarithmic spiral section 42*b* of the fixed wrap 42 may be formed in a shape of a logarithmic spiral curve, starting from a second point P413 up to the discharge end 0 of the fixed wrap 42 or up to a portion near the discharge end 0. The logarithmic spiral section 42*b* may be spirally rolled in a manner that a wrap thickness of the fixed wrap 42 increases toward the discharge end of the fixed wrap 42, namely, a wrap thickness t2 at a portion near the discharge end 0 may be thicker than a wrap thickness t1 at a portion near the second point P413. The multi-curve section 42*c* may be formed by connecting the arcuate section 42*a* and the logarithmic spiral curve section 42*b* with continuous multiple curves.

Similar to the outer surface, the arcuate section 42*a*, the logarithmic spiral section 42*b* and the multi-curve section 42*c* may also be formed, respectively, from a suction end P421 of the inner surface of the wrap to a first point P422, from a second point P423 of the inner surface to the discharge end 0 of the inner surface, and from the first point P422 of the inner surface to the second point P423.

The arcuate section 42*a* of the fixed wrap 42 may be formed in a shape of a wrap having a thickness t3 that constantly increases from the suction end P421 to the first point P422 as thick as the compression chamber being widened to an outer side and then decreases in the connection section 42*c* toward the logarithmic spiral section 42*b*. A maximum wrap thickness of the logarithmic spiral section 42*b* may be about 5.7 mm. Accordingly, upon designing the compression chambers with a high volume ratio, even if a discharge pressure is increased, damage on or to a portion of the fixed wrap near the discharge end may be prevented by virtue of the increased wrap thickness.

The arcuate section 42*a* of the fixed wrap 42 may extend from at least the suction end up to more than approximately 180° based on a rotational angle. If the arcuate section 42*a* extends by less than approximately 180°, an outer circumferential surface of the fixed scroll 40 may not be fully utilized and also an extension of a suction volume may be limited.

The arcuate section 42*a* of the fixed wrap 42 may be formed up to at least less than approximately 360°, more accurately, up to about 300°. That is, if the arcuate section 42*a* is formed too long, a start point of the logarithmic spiral section 42*b*, namely, the second point P413 may be located too adjacent to an end of the fixed wrap 42. This may make it difficult to form the wrap and smoothly form a compression chamber. Therefore, the arcuate shape 42*a* may be formed in a range in which the outer circumferential surface of the orbiting scroll 52 may be fully utilized and the compression chamber may be smoothly formed, namely, approximately from the end of the fixed wrap 42 up to a range of approximately 180° to 360°.

The discharge opening 44, through which refrigerant compressed in both compression chambers S may be discharged, may be formed at the discharge end of the fixed wrap 42. A bypass hole 45, through which refrigerant, which is being compressed, may partially bypass in advance, may be formed near the discharge hole 44.

The bypass hole 45 may have a diameter which is smaller than at least a minimum wrap thickness of the logarithmic spiral section 42*b*, namely, about 4.2 mm. Compared with the fact that a bypass hole of the conventional involute wrap is about 3 mm wide, the bypass hole 45 with this diameter may quickly bypass refrigerant, which is being over-compressed, so as to effectively prevent over-compression.

Meanwhile, the orbiting scroll 50 may include a disk 51 formed in a disk-like shape to execute an orbiting motion between the main frame 30 and the fixed scroll 42, the orbiting wrap 52 formed on an upper surface of the disk 51 and engaged with the fixed wrap 42 to form compression chambers S, and a boss 53 that protrudes from a lower surface of the disk 51 to be coupled to the rotational shaft 23.

The orbiting wrap 52 may be formed with a plurality of curves to correspond to the fixed wrap 42. That is, referring to FIG. 4, the orbiting wrap 52 may include an arcuate section 52*a* formed at an outer portion of the orbiting wrap 52, a logarithmic spiral section 52*b* formed at an inner portion of the orbiting wrap 52, and a multi-curve section 52*c* that connects the arcuate section 52*a* and the logarithmic spiral section 52*b*. An outer surface and an inner surface of the orbiting wrap 52 may be formed to correspond to each other.

For example, the orbiting wrap 52 may include an arcuate section 52*a* formed with a same radius, with respect to a discharge end 0' of the orbiting wrap 52, from a suction end P511 of an outer surface of the wrap to a first point P512, a logarithmic spiral section 52*b* formed from a second point P513 to the discharge end 0' of the orbiting wrap 52 or near the discharge end 0' and spirally rolled in a manner that a wrap thickness increases toward the discharge end 0' of the orbiting wrap 52, and a multi-curve section 52*c* that connects the arcuate section 52*a* and the logarithmic spiral section 52*b* with continuous multiple curves. Similar to the outer surface of the orbiting wrap 52, the arcuate section 52*a*, the logarithmic spiral section 52*b*, and the multi-curve section 52*c* may also be formed, respectively; from a suction end P521 of an inner surface of the wrap to a first point P522, from a second point P523 of the inner surface to the discharge end 0' of the orbiting wrap 52, and from the first point P522 of the inner surface to the second point P523.

The arcuate section 52*a* of the orbiting wrap 52 may be formed to have a same wrap thickness, but the logarithmic spiral section 52*b* may be formed such that its wrap thickness gradually increases from the first point P512, P522 to the second point P513, P523. Accordingly, upon designing the compression chambers with a high volume ratio, even if the discharge pressure is increased, damage on a portion of the orbiting wrap 52 near the discharge end may be prevented by virtue of the increased wrap thickness.

Unexplained reference numeral 11 denotes a suction space, 12 denotes a discharge space, 21 denotes a stator, and 22 denotes a rotor.

In the scroll compressor having the wrap shape according to embodiments, when power is applied to the drive motor 20, the rotational shaft 23 may rotate together with the rotor 22 so as to transfer a rotational force to the orbiting scroll 52. In response, the orbiting scroll 52 may execute an orbiting motion by an eccentric distance while being supported on the main frame 30 by the Oldham ring 60. Accordingly, a pair of compression chambers S (S1, S2), which continuously move, may be formed between the fixed wrap 42 and the orbiting wrap 52.

The compression chambers S (S1, S2) may move toward a center due to the orbiting motion of the orbiting scroll 50. During the movement, volumes of the compression chambers S (S1, S2) may be reduced such that a refrigerant is compressed. The compressed refrigerant may then be discharged into the discharge space 12 of the hermetic casing 10 through the discharge opening 44, which may communicate with the final compression chamber. These series of processes may be repetitively carried out.

A high compression ratio operation of a scroll compressor is required for a heating operation. In order to operate the scroll compressor at the high compression ratio, a suction volume should be increased significantly rather than a discharge volume. However, in view of characteristics of wraps of the scroll compressor, a volume of a compression chamber is previously decided upon during design of the wraps. In the related art, to increase the volume of the compression chamber of the scroll compressor, the number of turns of the wrap is increased or a height of a disk of a discharge side is increased more than that of a suction side. However, if the number of turns of the wrap is increased, a compressor size may be increased as well. Also, if the disk height of the discharge side is increased, rigidity of the wrap in a horizontal direction may be decreased.

Considering such drawbacks, in this embodiment, the arcuate section may be formed from each suction end P411, P421 or P511, P521 of the fixed wrap 42 or the orbiting wrap 52 to each first point P412, P422 or P512, P522 of the fixed wrap and the orbiting wrap, so as to increase a suction volume. On the other hand, the logarithmic spiral section in which the wrap thickness is increased may be formed from each second point P413, P423 or P513, P523 of the fixed wrap 42 and the orbiting wrap 52 to each discharge end 0, 0' of the fixed wrap 42 and the orbiting wrap 52. This structure may increase the volume ratio of the compressor so as to increase a capacity of the compressor and prevent damage to the wraps due to the high compression ratio operation, thereby enhancing reliability of the compressor.

Figure 6:
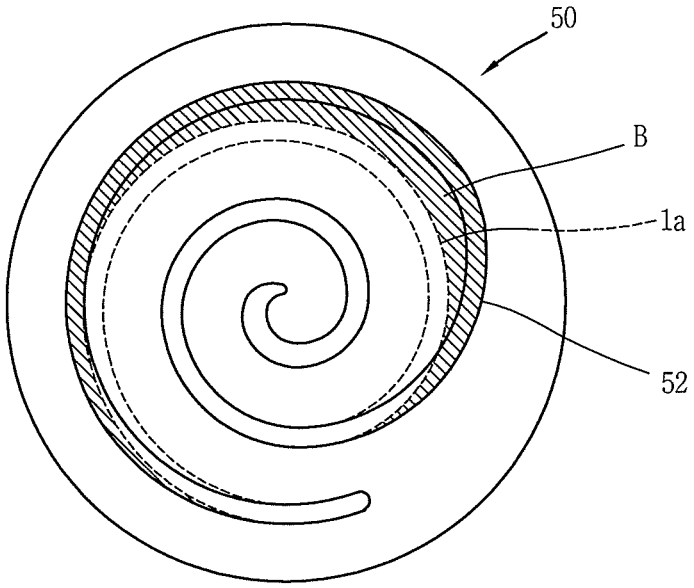
FIG. 6 is a planar view illustrating an enlarged compression chamber, to which the wrap shape of the scroll compressor of FIGS. 3 and 4 is applied, in comparison with the related art compression chamber.

Accordingly, as illustrated in FIG. 6, the orbiting wrap 52 may extend by a shaded area B to an outer circumferential surface of the disk 51 of the orbiting scroll 50. This may increase the suction volume to that extent, which may allow for designing the compression chambers with a high volumetric ratio.

FIG. 7 is a graph illustrating changes in a volume ratio in a case of applying the related art wrap formed in a shape of an involute curve and in a case of applying a wrap formed in a shape of an arcuate curve according to embodiments disclosed herein. As illustrated in FIG. 7, as compared with the related art, it can be noticed in the embodiments disclosed herein that a suction area may be increased by about 12.0% in A-path (S1) and increased by about 15.6% in B-path (S2). It can thus be noticed in the graph that a volume ratio may be increased from about 2.7 to 3.02 in A-path and increased from about 2.69 to 3.11 in B-path.

The foregoing embodiment illustrates a ring-shaped lower pressure scroll compressor; however, embodiments may equally be applied to scrolls of every type of scroll compressor, such as a high pressure type scroll compressor, or a horizontal type scroll compressor.

Embodiments disclosed herein provide a scroll compressor capable of operating at a high volume ratio so as to utilize even outer portions of a fixed wrap and an orbiting wrap as compression chambers. Embodiments disclosed herein further provide a scroll compressor capable of preventing damage to wraps at a discharge side or leakage in an axial direction due to a high volume ratio operation.

Embodiments disclosed herein provide a scroll compressor that may include a fixed scroll having a fixed wrap, and an orbiting scroll having an orbiting wrap engaged with the fixed wrap to form compression chambers, and orbitable with respect to the fixed wrap. Each of the fixed wrap and the orbiting wrap may be formed with an arcuate section from a suction end to an arbitrary point in a direction toward a discharge end, and a logarithmic spiral section from another arbitrary point to the discharge end.

The arcuate section may have a same radius based on the discharge end of each wrap. The arcuate section may be formed in a section from the suction end to a range of approximately 180° to 360° in a direction toward the discharge end.

The logarithmic spiral section may be formed such that a wrap thickness thereof is increased toward the discharge end of each wrap. A maximum wrap thickness of the logarithmic spiral section may be approximately 1.5 to 1.8 times of a maximum wrap thickness of the arcuate section.

A bypass hole may be formed near the discharge end of the fixed wrap, and a diameter of the bypass hole may be smaller than a wrap thickness of the logarithmic spiral section. A diameter of the bypass hole may be approximately 0.6 to 0.8 times of the wrap thickness of the logarithmic spiral section.

A multi-curve section may be formed between the arcuate section and the logarithmic spiral section in a manner of consecutively connecting a plurality of curves.

Embodiments disclosed herein provide a scroll compressor that may include a fixed scroll having a fixed wrap, and an orbiting scroll having an orbiting wrap engaged with the fixed wrap to form compression chambers, and orbitable with respect to the fixed wrap. An outer surface and an inner surface of each of the fixed wrap and the orbiting wrap may be formed to have a same radius, based on a discharge end of each wrap, from a suction end of each of the fixed wrap and the orbiting wrap to an arbitrary first point along a rotational angle, and a wrap thickness of each wrap may be gradually increased from an arbitrary second point to the discharge end along the rotational angle. A multi-curve section may be formed between the first point and the second point in a manner of consecutively connecting a plurality of curves. The arcuate section may be formed from the suction end of each wrap up to a range of approximately 180° to 300° based on the rotational angle. A maximum wrap thickness of the logarithmic spiral section may be approximately 1.5 to 1.8 times of a maximum wrap thickness of the arcuate section.

A discharge opening to discharge a compressed refrigerant therethrough may be formed at the fixed scroll or the orbiting scroll, and a bypass hole to bypass a portion of a refrigerant, which is being compressed, before the refrigerant reaches the discharge opening may be formed at the fixed scroll or the orbiting scroll. A diameter of the bypass hole may be approximately 0.6 to 0.8 times of a wrap thickness of the logarithmic spiral section.

A scroll compressor according to embodiments disclosed herein may be configured such that an arcuate section is formed from a suction end of a wrap to a first point to increase a suction volume, and a logarithmic spiral section in which a wrap thickness is increased is formed from a second point to a discharge end of the wrap. This may increase a volume ratio of the compressor so as to increase a capacity of the compressor and prevent damage to the wrap due to a high compression ratio operation, thereby enhancing reliability of the compressor.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a fixed scroll having a fixed wrap; and an orbiting scroll having an orbiting wrap engaged with the fixed wrap, the orbiting scroll orbiting with respect to the fixed scroll to form compression chambers therebetween, wherein each of the fixed wrap and the orbiting wrap is formed with an arcuate section from a suction end to a first point along a rotational angle in a direction toward a discharge end, and a logarithmic spiral section from a second point to the discharge end along the rotational angle, wherein the second point is closer to the discharge end than the first point, and wherein a maximum wrap thickness of the logarithmic spiral section is 1.5 to 1.8 times a maximum wrap thickness of the arcuate section.

2. The scroll compressor of claim 1, wherein the arcuate section of each wrap has a same radius from the discharge end along a length of the arcuate section.

3. The scroll compressor of claim 2, wherein the arcuate section is formed in a section from the suction end up to a range of 180° to 360° in a direction toward the discharge end.

4. The scroll compressor of claim 1, wherein the logarithmic spiral section of each wrap is formed such that a wrap thickness thereof increases toward the discharge end.

5. The scroll compressor of claim 1, wherein a bypass hole is formed near the discharge end of the fixed wrap, and wherein a diameter of the bypass hole is smaller than the wrap thickness of the logarithmic spiral section.

6. The scroll compressor of claim 5, wherein the diameter of the bypass hole is 0.6 to 0.8 times the wrap thickness of the logarithmic spiral section.

7. The scroll compressor of claim 1, wherein a multi-curve section is formed between the arcuate section and the logarithmic spiral section comprising a plurality of consecutively connected curves.

8. A scroll compressor, comprising:

a fixed scroll having a fixed wrap; and an orbiting scroll having an orbiting wrap engaged with the fixed wrap, the orbiting scroll orbiting with respect to the fixed scroll to form compression chambers therebetween, wherein an outer surface and an inner surface of each of the fixed wrap and the orbiting wrap are formed with an arcurate section having a same radius, with respect to a discharge end of the respective wrap, from a suction end to a first point along a rotational angle, and with a logarithmic section having a wrap thickness of each of the fixed wrap and the orbiting wrap gradually increasing from a second point to the discharge end along the rotational angle, wherein the second point is closer to the discharge end than the first point, and wherein a maximum wrap thickness of the logarithmic spiral section is 1.5 to 1.8 times a maximum wrap thickness of the arcuate section.

9. The scroll compressor of claim 8, wherein a multi-curve section is formed between the first point and the second point comprising a plurality of consecutively connected curves.

10. The scroll compressor of claim 8, wherein the arcuate section is formed from the suction end of each wrap up to a range of 180° to 300° based on the rotational angle.

11. The scroll compressor of claim 8, wherein a discharge opening to discharge compressed refrigerant therethrough is formed in the fixed scroll or the orbiting scroll, and a bypass hole to bypass a portion of refrigerant, which is being compressed, before the refrigerant reaches the discharge opening is formed in the fixed scroll or the orbiting scroll, and wherein a diameter of the bypass hole is 0.6 to 0.8 times of a wrap thickness of the logarithmic spiral section.

* * * * *